US011569605B2

(12) United States Patent
Nguyen Nhu et al.

(10) Patent No.: US 11,569,605 B2
(45) Date of Patent: Jan. 31, 2023

(54) CONTACT DEVICE AND CONTACT SYSTEM

(71) Applicant: TE Connectivity Germany GmbH, Bensheim (DE)

(72) Inventors: Lam Nguyen Nhu, Bensheim-Auerbach (DE); Olivier De Cloet, Lorsch (DE); Christian Schrettlinger, Bensheim (DE); Wolfgang Mueller, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 17/101,617

(22) Filed: Nov. 23, 2020

(65) Prior Publication Data

US 2021/0075142 A1 Mar. 11, 2021

Related U.S. Application Data

(63) Continuation-in-part of application No. 16/445,873, filed on Jun. 19, 2019, now Pat. No. 10,847,924, (Continued)

(30) Foreign Application Priority Data

Dec. 20, 2016 (DE) ..... 102016125029.5

(51) Int. Cl.
*H01R 13/426* (2006.01)
*H01R 13/506* (2006.01)
*H01R 13/52* (2006.01)

(52) U.S. Cl.
CPC ..... *H01R 13/426* (2013.01); *H01R 13/506* (2013.01); *H01R 13/521* (2013.01)

(58) Field of Classification Search
CPC ... H01R 13/426; H01R 13/506; H01R 13/571
(Continued)

(56) References Cited

U.S. PATENT DOCUMENTS 5,222,909 A * 6/1993 Nomura ..... H01R 13/6582 439/271
5,490,785 A 2/1996 Hein et al.
(Continued)

FOREIGN PATENT DOCUMENTS

CN 1211836 C 7/2005
CN 101330175 A 12/2008
(Continued)

OTHER PUBLICATIONS

Chinese First Office Action and English translation, dated Apr. 29, 2020, 18 pages.
(Continued)

*Primary Examiner* — Alexander Gilman
(74) *Attorney, Agent, or Firm* — Barley Snyder

(57) ABSTRACT

A contact device includes an outer housing delimiting an inner space and an inner housing arranged in the inner space, the inner housing having a first recess. The contact device includes a contact element arranged in the inner space and a sealing element arranged between the contact element and the outer housing. The sealing element seals the inner space from the environment. The contact element has a second recess on an outside of the contact element aligned with the first recess. The contact device includes a contact securing device movable along the first recess to engage the second recess of the contact element.

15 Claims, 12 Drawing Sheets

Related U.S. Application Data which is a continuation of application No. PCT/EP2017/083746, filed on Dec. 20, 2017.

(58) Field of Classification Search
USPC ..... 439/587
See application file for complete search history.

(56) References Cited

U.S. PATENT DOCUMENTS

| | | | | |
|---|---|---|---|---|
| 5,752,852 | A | 5/1998 | Onoda | |
| 5,997,349 | A * | 12/1999 | Yoshioka | H01R 13/6593 439/579 |
| 6,811,817 | B2 | 11/2004 | Sugeta et al. | |
| 7,029,327 | B2 * | 4/2006 | Devine | H01R 24/542 439/587 |
| 7,059,902 | B2 | 6/2006 | Nakamura | |
| 7,229,303 | B2 | 6/2007 | Vermoesen et al. | |
| 7,481,675 | B2 | 1/2009 | Patterson et al. | |
| 7,591,668 | B2 * | 9/2009 | Nakamura | H01R 13/641 439/489 |
| 7,695,301 | B2 | 4/2010 | Mudge, III et al. | |
| 8,133,076 | B2 * | 3/2012 | Nakamura | H01R 13/516 439/587 |
| 8,235,752 | B2 | 8/2012 | Nakamura | |
| 8,277,250 | B2 | 10/2012 | Suzuki et al. | |
| 8,608,508 | B2 | 12/2013 | Kataoka | |
| 8,845,361 | B2 | 9/2014 | Magno, Jr. et al. | |
| 8,851,925 | B2 | 10/2014 | Kataoka et al. | |
| 8,939,799 | B2 * | 1/2015 | Watanabe | H01R 13/627 439/686 |
| 9,231,337 | B2 | 1/2016 | Sakakura | |
| 9,385,516 | B2 | 7/2016 | Tanaka | |
| 9,543,702 | B2 * | 1/2017 | Horiuchi | H01R 13/641 |
| 9,865,964 | B2 * | 1/2018 | Hashimoto | H01R 13/5205 |
| 9,929,506 | B2 * | 3/2018 | Hashimoto | H01R 13/533 |
| 9,948,025 | B2 * | 4/2018 | Hashimoto | H01R 13/533 |
| 10,847,924 | B2 * | 11/2020 | Nguyen Nhu | H01R 13/521 |
| 2005/0118850 | A1 | 6/2005 | Ito | |
| 2005/0176298 | A1 * | 8/2005 | Flowers | H01R 13/4365 439/595 |
| 2006/0063412 | A1 | 3/2006 | Matsumoto et al. | |
| 2007/0059970 | A1 | 3/2007 | Ichio et al. | |
| 2009/0019754 | A1 | 7/2009 | Mase et al. | |
| 2009/0247000 | A1 | 10/2009 | Shuey | |
| 2011/0045696 | A1 * | 2/2011 | Nakamura | H01R 13/5202 439/587 |
| 2011/0143566 | A1 | 6/2011 | Nakamura | |
| 2013/0333944 | A1 | 12/2013 | Sakakura | |
| 2014/0011400 | A1 | 1/2014 | Shiga | |
| 2015/0144395 | A1 | 5/2015 | Tanaka | |
| 2015/0333430 | A1 * | 11/2015 | Hashimoto | H01R 13/639 439/752 |

FOREIGN PATENT DOCUMENTS

| | | | |
|---|---|---|---|
| CN | 101997228 | A | 3/2011 |
| CN | 102157843 | A | 8/2011 |
| CN | 103515774 | A | 1/2014 |
| CN | 104145379 | A | 11/2014 |
| CN | 103515775 | A | 1/2016 |
| DE | 19532381 | A1 | 3/1997 |
| DE | 102004030809 | A1 | 2/2005 |
| EP | 0903814 | A1 | 3/1999 |
| EP | 0996199 | A2 | 4/2000 |
| JP | 2000091023 | A | 3/2000 |
| JP | 2002203637 | A | 7/2002 |
| JP | 2003109702 | A | 4/2003 |
| JP | 2009181724 | A | 8/2009 |
| JP | 2013048019 | A | 3/2013 |
| JP | 2013258117 | A | 12/2013 |
| JP | 201417119 | A | 1/2014 |

OTHER PUBLICATIONS

PCT Notification of Transmittal, The International Search Report and The Written Opinion of the International Searching Authority, International Application No. PCT/EP2017/083746, dated Mar. 27, 2018, 14 pages.

Indian Patent Office Examination Report, dated Aug. 31, 2020, 5 pages.

Japanese Notice of Reasons for Refusal and English translation, dated Aug. 18, 2020, 10 pages.

EPO Communication, dated Dec. 17, 2020, 7 pages.

Office Action from the Japanese Patent Office in Japanese Patent Appln. No 2021007693, dated Nov. 16, 2021 and English translation thereof, 13 pp.

English Abstract of JP2002203637, dated Jul. 19, 2002, 1 p.

* cited by examiner

CONTACT DEVICE AND CONTACT SYSTEM

CROSS-REFERENCE TO RELATED APPLICATIONS

This application is a continuation-in-part of U.S. patent application Ser. No. 16/445,873, filed on Jun. 19, 2019, which is a continuation of PCT International Application No. PCT/EP2017/083746, filed on Dec. 20, 2017, which claims priority under 35 U.S.C. § 119 to German Patent Application No. 102016125029.5, filed on Dec. 20, 2016.

FIELD OF THE INVENTION

The present invention relates to a contact device and, more particularly, to a contact device sealed from an environment.

BACKGROUND

Many different configurations of contact systems with contact devices have an inner space of the contact device sealed from the environment of the contact system.

SUMMARY

A contact device includes an outer housing delimiting an inner space and an inner housing arranged in the inner space, the inner housing having a first recess. The contact device includes a contact element arranged in the inner space and a sealing element arranged between the contact element and the outer housing. The sealing element seals the inner space from the environment. The contact element has a second recess on an outside of the contact element aligned with the first recess. The contact device includes a contact securing device movable along the first recess to engage the second recess of the contact element.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
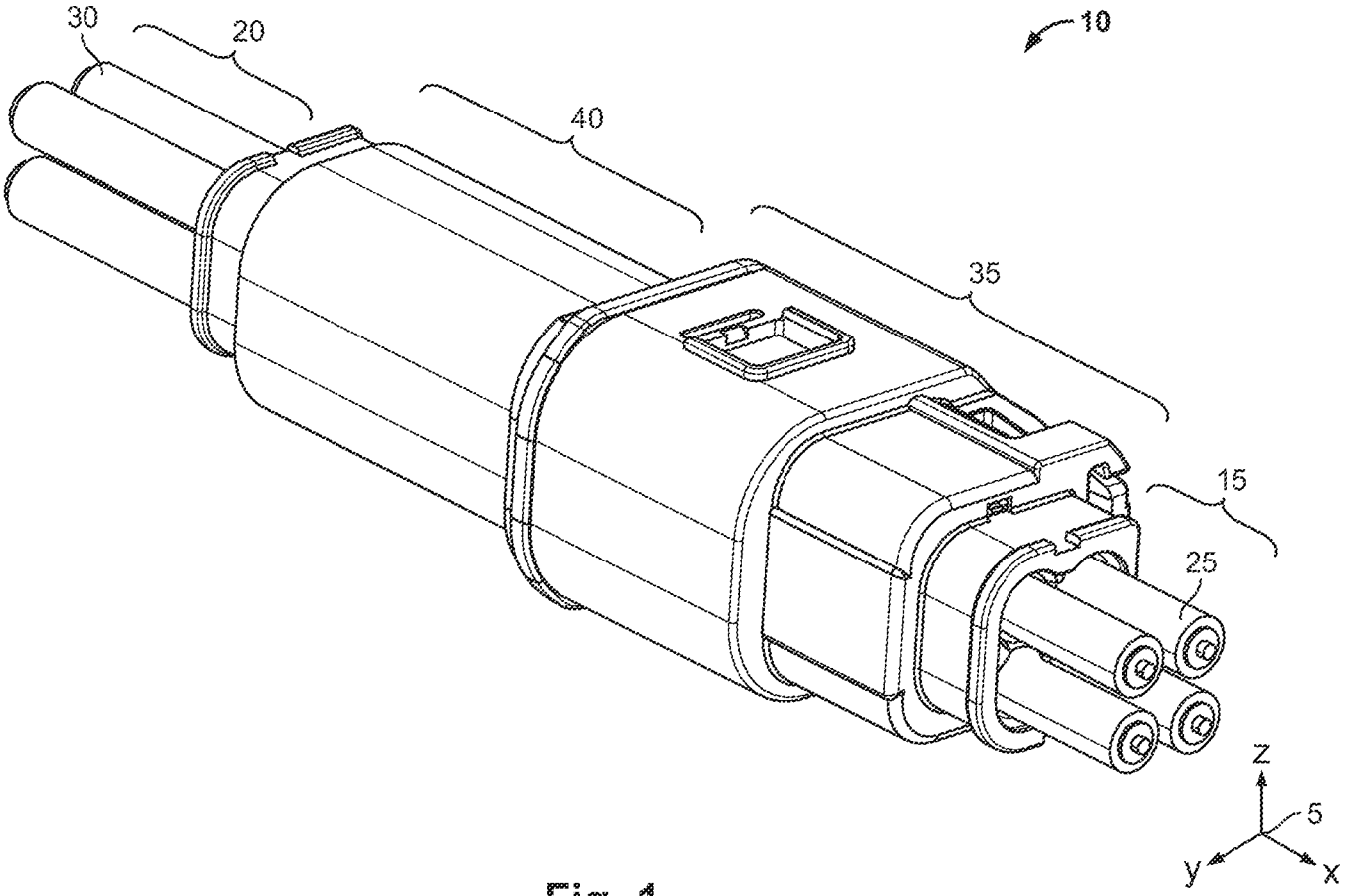
FIG. 1 is a perspective view of a contact system.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the disclosure to those skilled in the art.

In the following figures, a coordinate system 5 is referred to. The coordinate system 5 is formed by way of example as a right-handed trihedron and has an x-axis, a y-axis, and a z-axis. The x-axis extends in the longitudinal direction. The y-axis extends in the transverse direction and the z-axis in the vertical direction. Of course, the coordinate system 5 can also be formed differently.

A contact system 10 according to an embodiment, shown in FIG. 1, is formed to provide an electrical connection between a first electrical conductor 15 and a second electrical conductor 20.

The first electrical conductor 15 and the second electrical conductor 20 have a plurality of conductor strands 25, 30 in the embodiment shown in FIG. 1. In the embodiment, each of the conductor strands 25, 30 is formed as a coaxial conductor with a first electrical conductor and a second electrical conductor which is arranged coaxially to the first electrical conductor. In an embodiment, each electrical conductor 15, 20 has four conductor strands 25, 30. In other embodiments, a different number of conductor strands 25, 30 can also be provided which are electrically connected to each other by the contact system 10. The conductor strand 25, 30 can also be formed differently and comprise only one electrical conductor, for example.

The contact system 10, as shown in FIG. 1, has a first contact device 35 and a second contact device 40. The first contact device 35 is connected to the first electrical conductor 15. The second contact device 40 is connected to the second electrical conductor 20.

Figure 2:
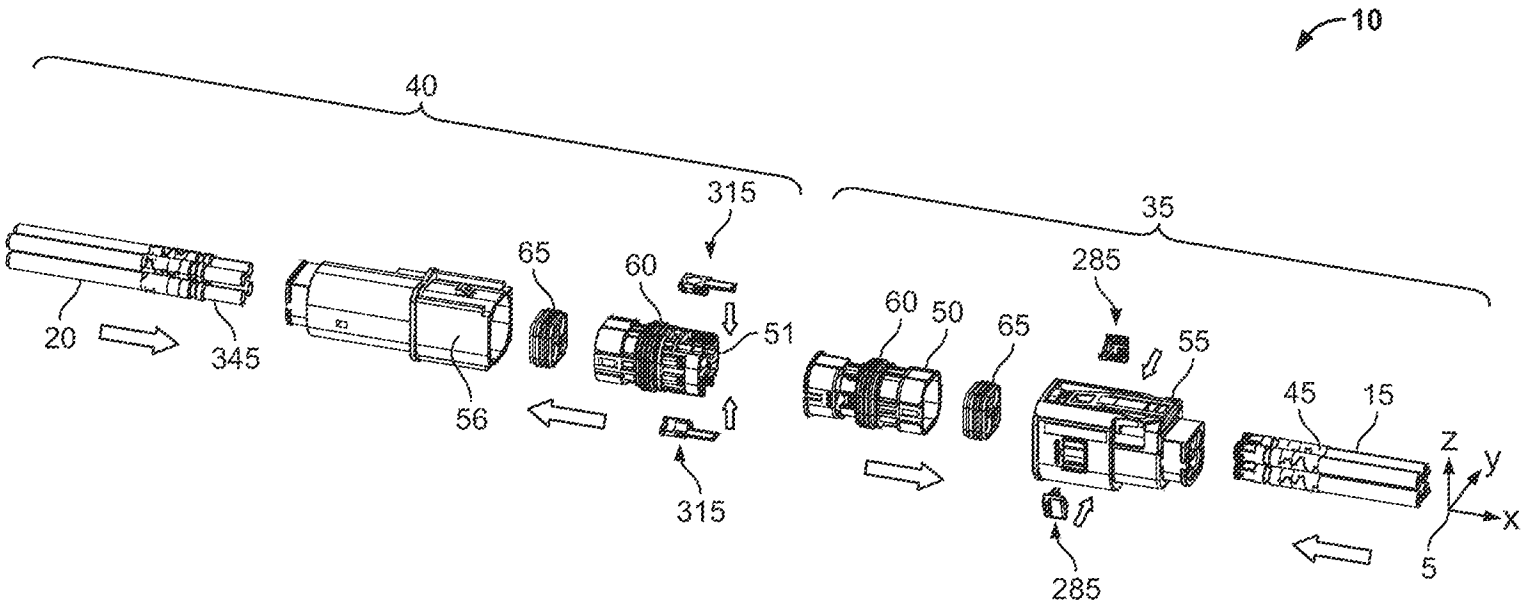
FIG. 2 is an exploded perspective view of the contact system.

As shown in FIG. 2, the first contact device 35 has at least a first contact element 45, an inner housing 50, an outer housing 55, a first sealing element 60, and a second sealing element 65. In the shown embodiment, the first contact device 35 has a first contact securing device 285.

Figure 7:
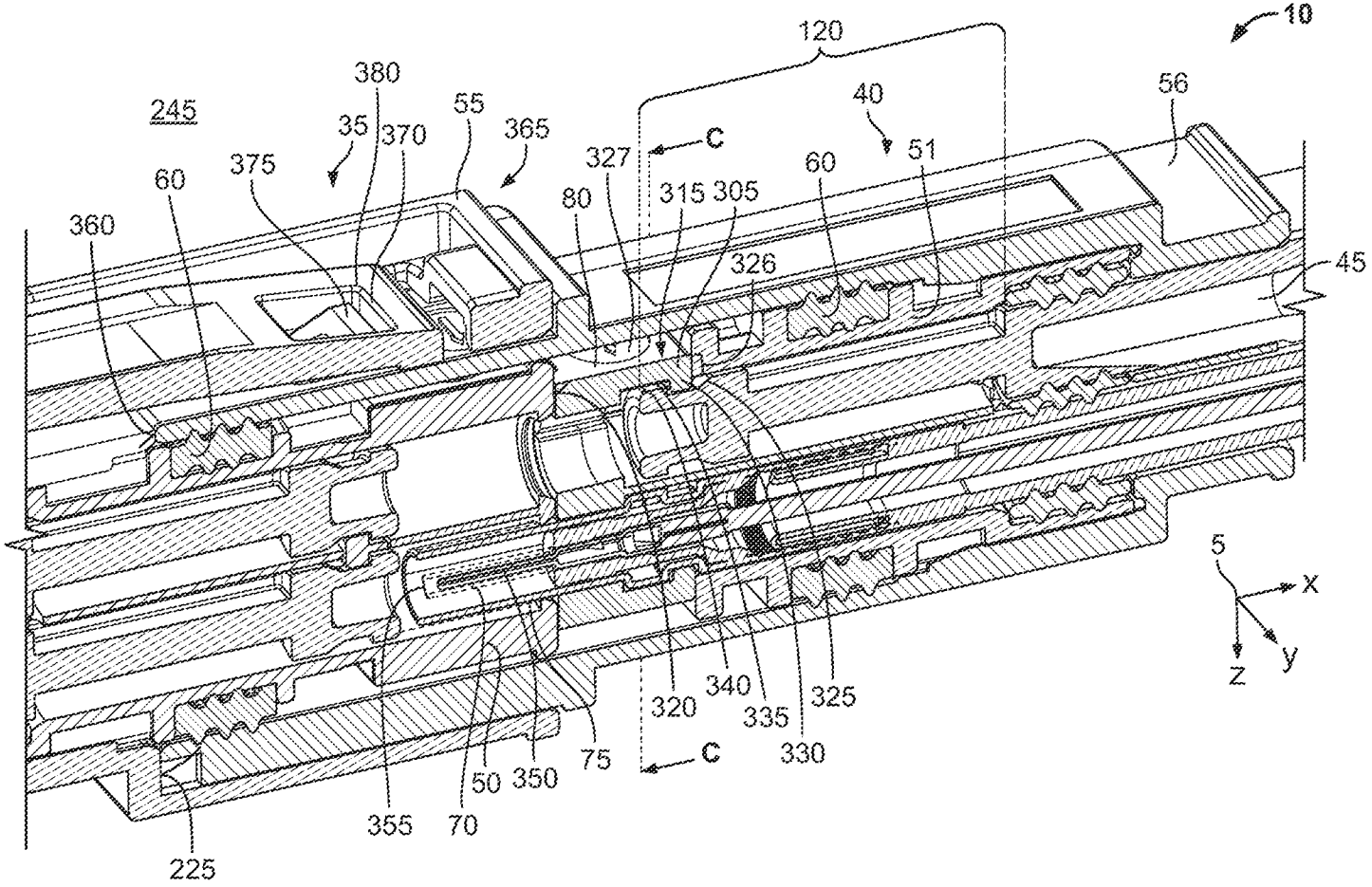
FIG. 7 is a sectional perspective view of a second portion of the contact system.
Figure 8:
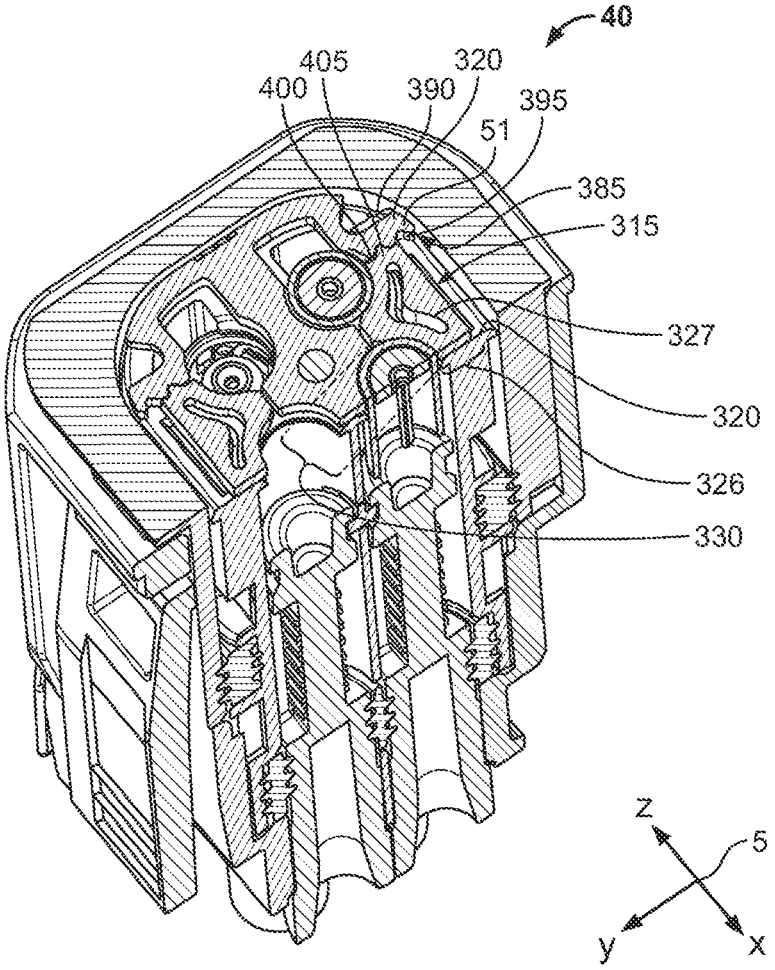
FIG. 8 is a sectional perspective view of the second portion of the contact system, taken along plane C-C of FIG. 7.

The second contact device 40, apart from small deviations which are referred to in FIGS. 7 and 8, is formed in its constructional features substantially identically to the first contact device 35 and has a second contact element 345, an inner housing 51, an outer housing 56, the first sealing element 60, and the second sealing element 65. Furthermore, the second contact device 40 has a second contact securing device 315 in the shown embodiment. The geometric configurations of the second contact device 40 and the first contact device 35 are coordinated.

Figure 3:
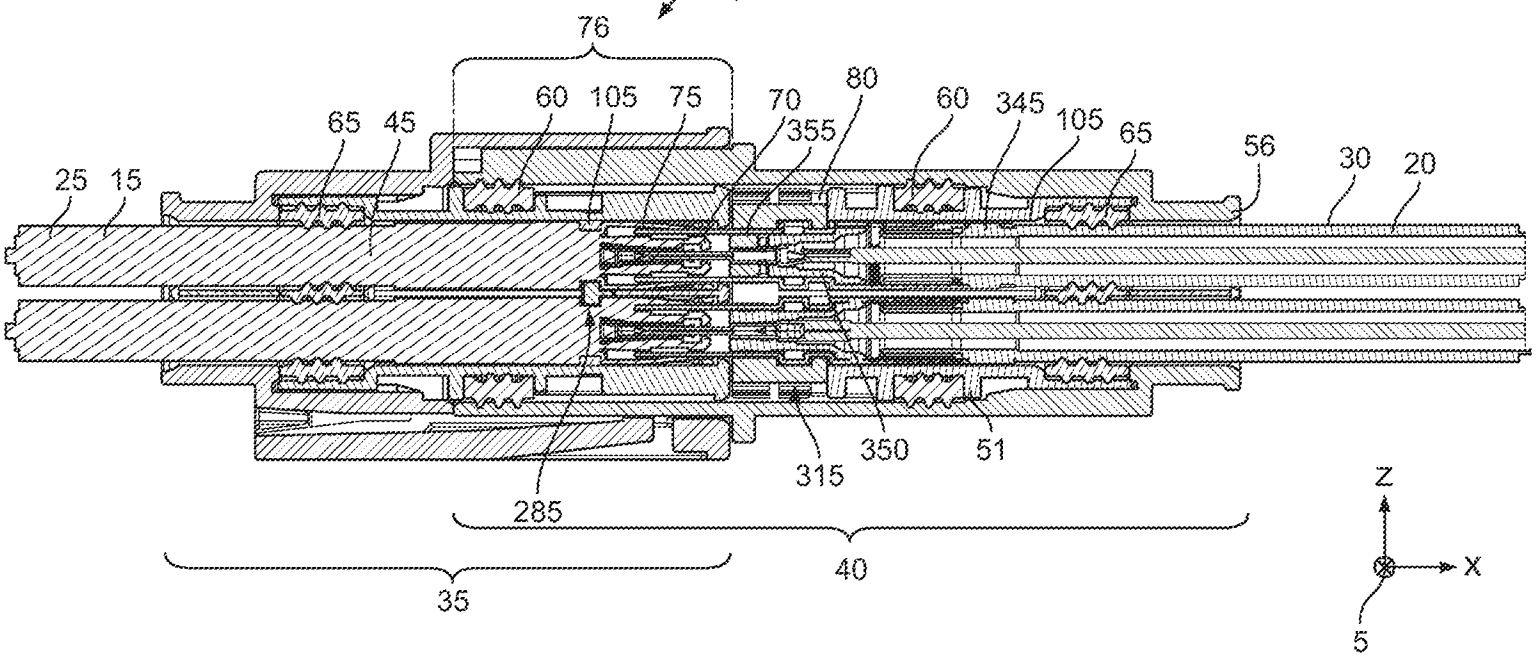
FIG. 3 is a sectional side view of the contact system.

In the contact system 10, as shown in FIG. 3, the first contact element 45 is formed as a first coaxial contact element and has a first plug contact 70 and a first bushing contact 75 in an embodiment. In this case, the first plug contact 70 is arranged coaxially to the first bushing contact 75. Of course, it is also conceivable that the first contact element 45 is also formed differently.

In the embodiment shown in FIG. 3, a first contact element 45 is provided for each first conductor strand 25, the first contact element 45 being electrically connected to the first conductor strand 25. Correspondingly, four first contact elements 45 are provided respectively in the embodiment by way of example, which, at equal intervals, are offset relative to each other in the transverse direction and are arranged spaced apart from each other in the vertical direction. In this embodiment, two first contact elements 45 are arranged respectively in a common xy-plane. Of course, it is also conceivable that the first contact elements 45 are also arranged in a common plane.

As shown in FIG. 3, the second contact device 40 has a second contact element 345 for every second conductor strand 30, instead of the first contact element 45. The second contact element 345 is formed similarly to the first contact element 45. The second contact element 345 has a second bushing contact 350 and a second plug contact 355. The second bushing contact 350 is arranged coaxially to the second plug contact 355. The second bushing contact 350 and the first plug contact 70 engage each other. The second plug contact 355 engages in the first bushing contact 75. As a result, a reliable electrical connection between the first contact element 45 and the second contact element 345 is guaranteed.

In the assembled state, the outer housing 56 of the second contact device 40 engages in the outer housing 55 of the first contact device 35. In this case, the outer housing 56 of the second contact device 40 is arranged on the outside between the outer housing 55 of the first contact device 35 and the first sealing element 60.

The outer housing 56 of the second contact device 40 has a housing engaging section 76, as shown in FIG. 3. The housing engaging section 76 engages in the outer housing 50 of the first contact device 35. The outer housings 55, 56 delimit a first inner space 80. The inner housings 50, 51 are arranged in the first inner space 80. The inner housings 50, 51 delimit a second inner space 105.

Figure 4:
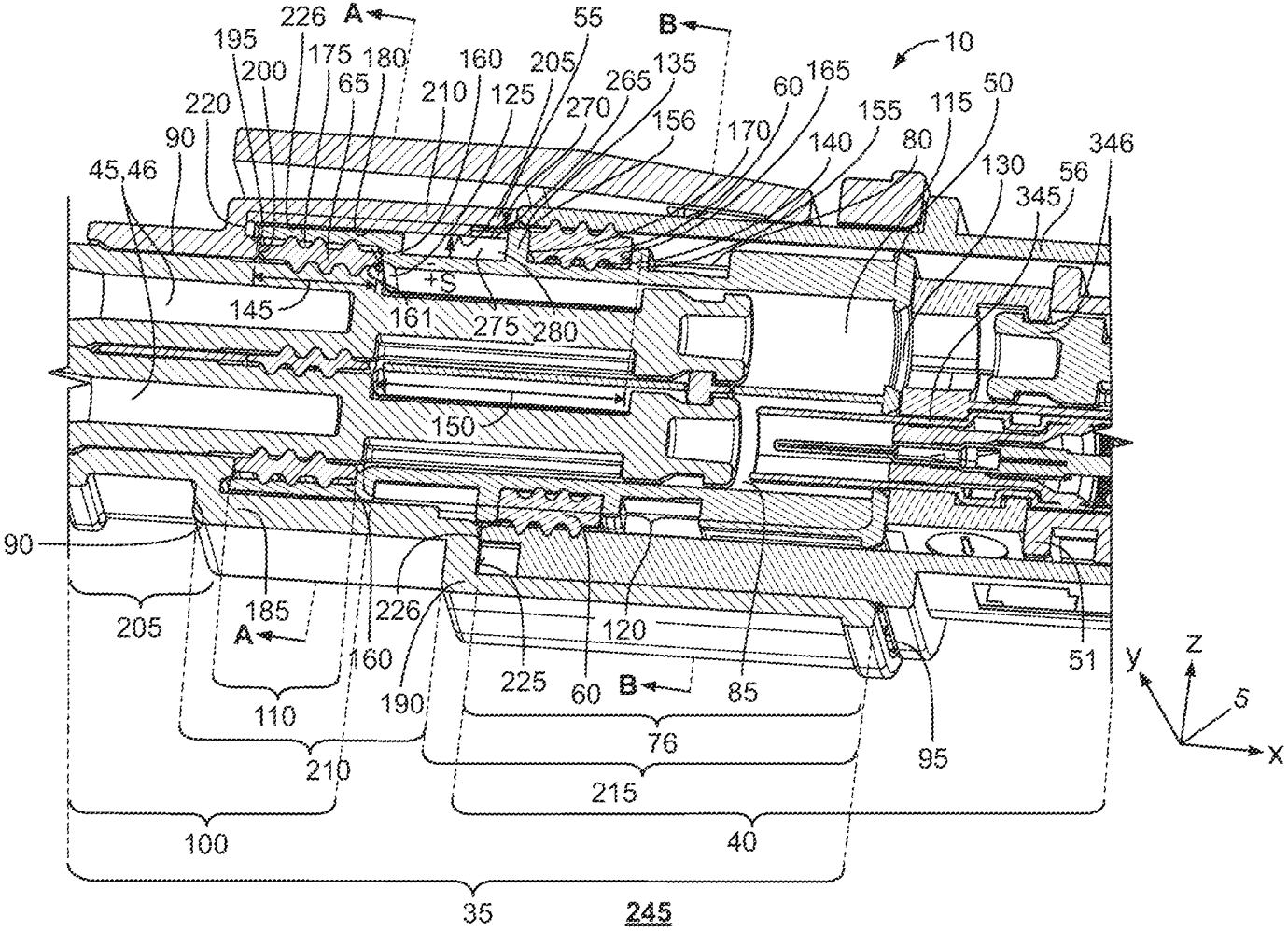
FIG. 4 is a sectional side view of a first portion of the contact system.

As shown in FIGS. 3 and 4, the first sealing element 60 of the first contact device 35 is arranged between the inner housing 50 of the first contact device 35 and the outer housing 56 of the second contact device 40, and seals off the first inner space 80 from an environment 245. The first sealing element 60 of the second contact device 40 is arranged between the inner housing 51 of the second contact device 40 and the outer housing 56 of the second contact device 40, and seals off the first inner space 80 from the environment 245. The second sealing elements 65 of the two contact devices 35, 40 reliably seal off the second inner space 105 at the respective contact element 45, 345 and the inner housings 50, 51 from the environment 245.

A sealing plug 46, 346 is shown in FIG. 4 partially instead of the contact element 45, 345. The sealing plug 46, 346 and the contact element 45, 345 have a substantially identical outer geometry. The features described hereinafter for the contact element 45, 345 also apply to the sealing plugs 46, 346, with the exception that the sealing plugs 46, 346 do not provide an electrical connection and do not engage each other. The sealing plugs 46, 346 close off the contact device 35, 40 from the environment 245 and seal off the second inner space 105 from the environment 245. The sealing plug 46, 346 has a plastic as its material.

The outer housing 55 of the first contact device 35, in an embodiment, has a substantially rectangular cross-section. Furthermore, the outer housing 55 of the first contact device 35 has a first opening 90 at a first longitudinal end and a second opening 95 at a second longitudinal end, as shown in FIG. 4. The first opening 90 is formed corresponding to an outside, geometric configuration of a connection section 100 of the contact element 45, 345. The connection section 100 is connected to the associated electrical conductor 15, 20 at one side and connected to a securing section 120 of the contact element 45, 345 at the other side. The securing section 120 is arranged on the outside of the contact element 45, 345. Furthermore, the connection section 100 engages through the first opening 90. The second opening 95 is arranged in the longitudinal direction opposite the first opening 90. In the second opening 95 of the outer housing 55 of the first contact device 35, the outer housing 56 engages in the second contact device 40.

The second inner space 105, as shown in FIG. 4, has a first inner space section 110 and at least one second inner space section 115. The second inner space section 115 is formed in a chamber-like manner. The securing section 120 of the contact element 45, 345 is arranged in the second inner space section 115. In an embodiment, the second inner space section 115 is cylindrically formed. The second inner space section 115 opens out at a side which faces the first opening 90 at a third opening 125 of the inner housing 50 in the first inner space section 110. The first contact element 45 engages through the third opening 125.

The first inner space section 110 is formed wider than the second inner space section 115 in the transverse direction, such that at the first inner space section 110 a plurality of second inner space sections 115 can open out at a longitudinal side of the first inner space section 110. The inner housing 50 of the first contact device 35 has a fourth opening 130 in the longitudinal direction on the side which is opposite the first inner space section 110, at which fourth opening 130 the second inner space section 115 similarly opens out. The second contact element 345 engages through the fourth opening 130.

As shown in FIG. 4, the inner housing 50 of the first contact device 35 has a first sealing receptacle 140 at a first outer peripheral surface 135. The first sealing receptacle 140 is open outwardly towards the outer housings 55, 56 of the contact devices 35, 40 and has a rectangular cross-section in the longitudinal section. The first sealing receptacle 140 is arranged circumferentially around the inner housing 50. The first sealing element 60 is arranged in the first sealing receptacle 140. The outer housing 56 of the second contact device 40 is arranged on the outside in the longitudinal direction at the level of the first sealing element 60 and the outer housing 55 of the first contact device 35 is arranged on the outside of the outer housing 56 of the second contact device 40.

The inner housing 50 of the first contact device 35, as shown in FIG. 4, has a first housing section 145, a second housing section 150, a first web 155, and a second web 156.

As shown in FIG. 4, the first housing section 145 and the second housing section 150 extend in the longitudinal direction. The first housing section 145 abuts against the second housing section 150 in the longitudinal direction. The first housing section 145 is formed wider than the second housing section 150 in the transverse direction. In this case, a first shoulder 160 with a shoulder surface 161 is arranged at a transition between the first housing section 145 and the second housing section 150. The shoulder surface 161 extends in a yz-plane in an embodiment.

The first web 155 and the second web 156 are arranged offset relative to the first shoulder 160 and relative to the first housing section 145 in the longitudinal direction. In the embodiment shown in FIG. 4, the second web 156 is arranged on the outside of the second housing section 150 between the first shoulder 160 and the first web 155. The first web 155 is arranged on the outside of the second housing section 150.

In the embodiment shown in FIG. 4, the first web 155 and the second web 156 are arranged circumferentially at the first outer peripheral surface 135 of the inner housing 50 of the first contact device 35. In embodiments, the first web 155 and/or the second web 156 can also have interruptions. In an embodiment, the first web 155 is formed shorter than the second web 156 in the transverse direction. In other embodiments, the first web 155 can also be formed wider than or be the same width as the second web 156.

As shown in FIG. 4, the first web 155 delimits the first sealing receptacle 140 at a first longitudinal end with a first side surface 165, and the second web 156 delimits the first sealing receptacle 140 at a second longitudinal end with a second side surface 170. The first side surface 165 and the second side surface 170 are arranged parallel to each other in the embodiment and are perpendicular to the first outer peripheral surface 135 in the first sealing receptacle 140. Furthermore, the first and the second side surfaces 165, 170 each extend in a yz-plane. The first sealing receptacle 140 is delimited by the first outer peripheral surface 135 of the second housing section 150 in the transverse direction and vertical direction. On the outside, the first sealing receptacle 140 is delimited by the outer housing 56 of the second contact device 40.

The contact device 35, 40 further has a second sealing receptacle 175 as shown in FIG. 4. The second sealing element 65 is arranged in the second sealing receptacle 175. The second sealing receptacle 175 is delimited on the outside by a first inner peripheral surface 180 of the first housing section 145. A first longitudinal end of the second sealing receptacle 175 is delimited by the first shoulder 160.

The outer housing 55 of the first contact device 35 is formed in a tiered manner and has a second shoulder 185 and a third shoulder 190. The outer housing 55 has a first outer housing section 205, a second outer housing section 210, and a third outer housing section 215. The second shoulder 185 is arranged between the first outer housing section 205 and the second outer housing section 210. The third shoulder 190 is arranged between the second outer housing section 210 and the third outer housing section 215. The first outer housing section 205 has a smaller transverse extension than the second outer housing section 210. The second outer housing section 210 has a shorter transverse extension than the third outer housing section 215.

The third shoulder 190 is arranged offset relative to the second shoulder 185 in the longitudinal direction, as shown in FIG. 4. The second shoulder 185 abuts against the first opening 90 of the outer housing 55 of the first contact device 35. A protrusion 195 is provided at the second shoulder 185 on a longitudinal side which faces the second sealing receptacle 175. A third side surface 200 is arranged at the protrusion 195. The protrusion 195 is arranged in the transverse direction at the level of the first shoulder 160 of the inner housing 50 of the first contact device 35. The third side surface 200 is aligned parallel to the shoulder surface 161 in an embodiment. The third side surface 200 delimits a second longitudinal end of the second sealing receptacle 175.

A receptacle 220 is provided between the protrusion 195 and the second outer housing section 210 at the second shoulder 185, as shown in FIG. 4. The receptacle 220 is delimited on the outside by a second inner peripheral surface 206 of the second outer housing section 210 and on the inside by the protrusion 195. The receptacle 220 is delimited by the second shoulder 185 in the longitudinal direction. In the assembled state of the first contact device 35, an end face of the first housing section 145 of the inner housing 50 of the first contact device 35 on a side which faces away from the first outer housing section 205 engages in the receptacle 220.

The third shoulder 190 is arranged between the first sealing element 60 and the second sealing element 65 in the longitudinal direction. The third shoulder 190 is substantially arranged by way of example at the level of the second web 156 in the longitudinal direction. In this case, the third shoulder 190 has a stop surface 225. The stop surface 225 is arranged on a longitudinal side, which faces the first sealing element 60, of the third shoulder 190. An end face 226 of the outer housing 56 of the second contact device 40 rests against the stop surface 225 of the first contact device 35.

In order to guarantee an axial position of the inner housing 50 of the first contact device 35 relative to the outer housing 55 of the first contact device 35 in the inserted state, the outer housing 55 of the first contact device 35 can additionally comprise a first bearing surface 265 and the inner housing 50 can comprise a second bearing surface 270 and a tensioning device 275, as shown in FIG. 4. The first bearing surface 265 and the second bearing surface 270 are, in this case, aligned conically and/or running obliquely towards the x-axis. In this case, a low inclination by a few degrees is enough for the bearing surface 265, 270 relative to the x-axis. In the embodiment, the bearing surface 265, 270 is arranged between the first sealing element 60 and the second sealing element 65 in the longitudinal direction. To form the tensioning device 275, the inner housing 50 has a thickening 280 on the outside of the second housing section 150. The thickening 280 is, in this case, arranged between the second web 156 and the first shoulder 160 in the longitudinal direction. The thickening 280 connects the second web 156 to the first shoulder 160 by way of example. The second bearing surface 270 is arranged on the outside of the tensioning device 275.

Upon insertion of the inner housing 50 of the first contact device 35 into the outer housing 55 of the first contact device 35, the tensioning device 275 is elastically tensioned in the transverse direction by the oblique alignment of the bearing surface 265, 270. In the end position, the tensioning device 275 presses the second bearing surface 270 in the transverse direction outwardly onto the first bearing surface 265 with a pretensioning force FS and thus ensures an unwanted withdrawal, for example in the event of the contact system 10, the inner housing 50 of the first contact device 35 being released from the outer housing 55 of the first contact device 35. Furthermore, a quick assembly option of the first contact device 35 is guaranteed by the tensioning device 275. The arrangement of the tensioning device 275 and the bearing surface 265, 270 in the longitudinal direction between the first sealing element 60 and the second sealing element 65 guarantees that the second sealing element 65 can reliably seal off the second inner space 105 and the first sealing element 60 can reliably seal off the first inner space 80 from the environment 245.

Figure 5:
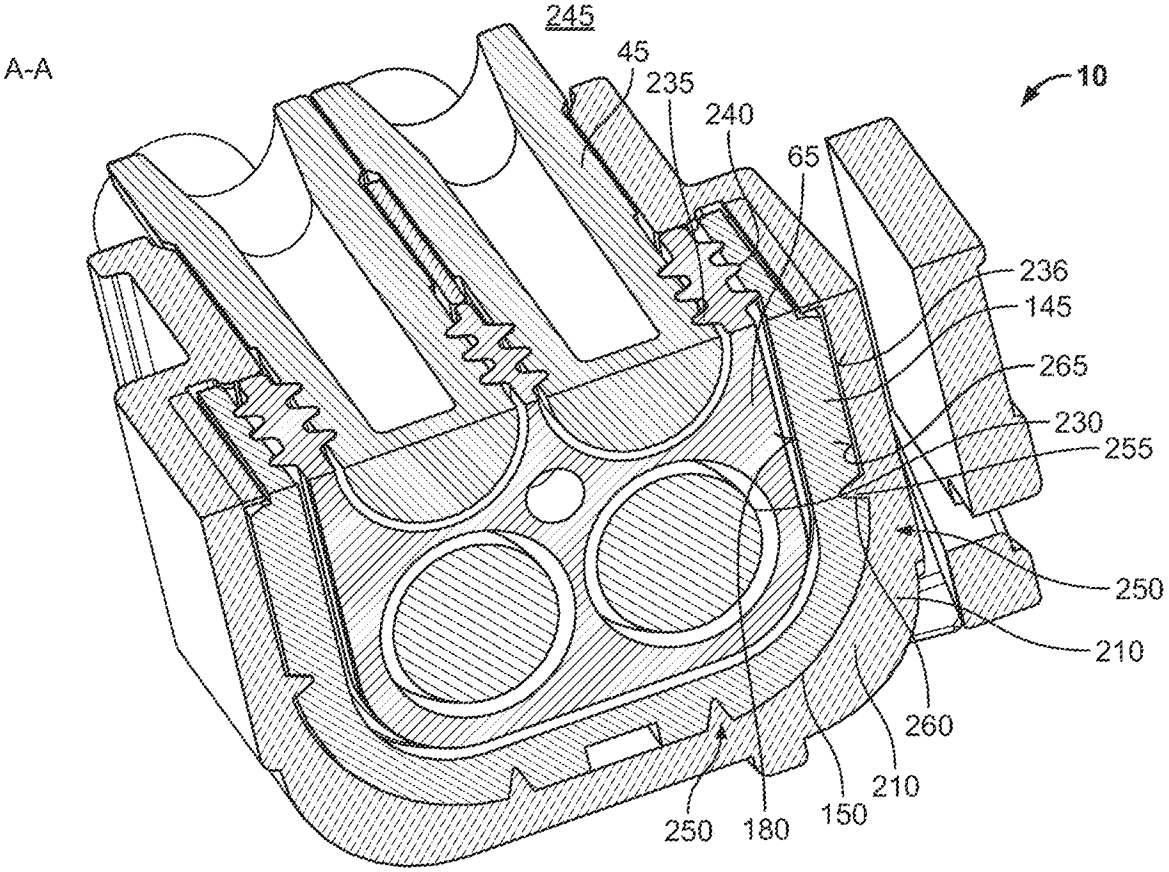
FIG. 5 is a sectional perspective view of the first portion of the contact system, taken along plane A-A of FIG. 4.

In an embodiment, the sealing element 60, 65 is made from an elastomer. The second sealing element 65, as shown in FIG. 5, has a notch 230 for each contact element 45, 345 respectively. The notch 230 is selected corresponding to the geometric configuration of the connection section 100, which is guided through the notch 230.

The first sealing element 60 can have at least one first sealing lip 235 in the notch 230 in order to achieve a reliable seal at the contact element 45, 345 of the second inner space 105. At least one second sealing lip 240 is also provided at a second outer peripheral surface 236 of the second sealing element 65, as shown in FIG. 5. The second sealing lips 240 rest on the first inner peripheral surface 180 in the second sealing receptacle 175. As a result, the second inner space 105 is reliably sealed off from the environment 245 of the contact system 10.

The first contact device 35 has a guide device 250, shown in FIG. 5. The guide device 250 has a guide rail 255 extending in the longitudinal direction and a guide receptacle 260 extending in the longitudinal direction. The guide rail 255 and the guide receptacle 260 engage each other. The guide receptacle 260 is arranged on the outside, for example, of the second housing section 150. The guide rail 255 is arranged on the inside of the second outer housing section 210. The guide device 250 ensures that upon insertion of the inner housing 50 of the first contact device 35 into the outer housing 55 of the first contact device 35, the inner housing 50 of the first contact device 35 is not canted and can be inserted as far as its end position, which is fixed by engaging the first housing section 145 in the receptacle 220. Of course, the guide receptacle 260 can also be arranged on the inside of the outer housing 55 of the first contact device 35 and the guide rail 255 on the outside of the inner housing 50 of the first contact device 35.

Figure 6:
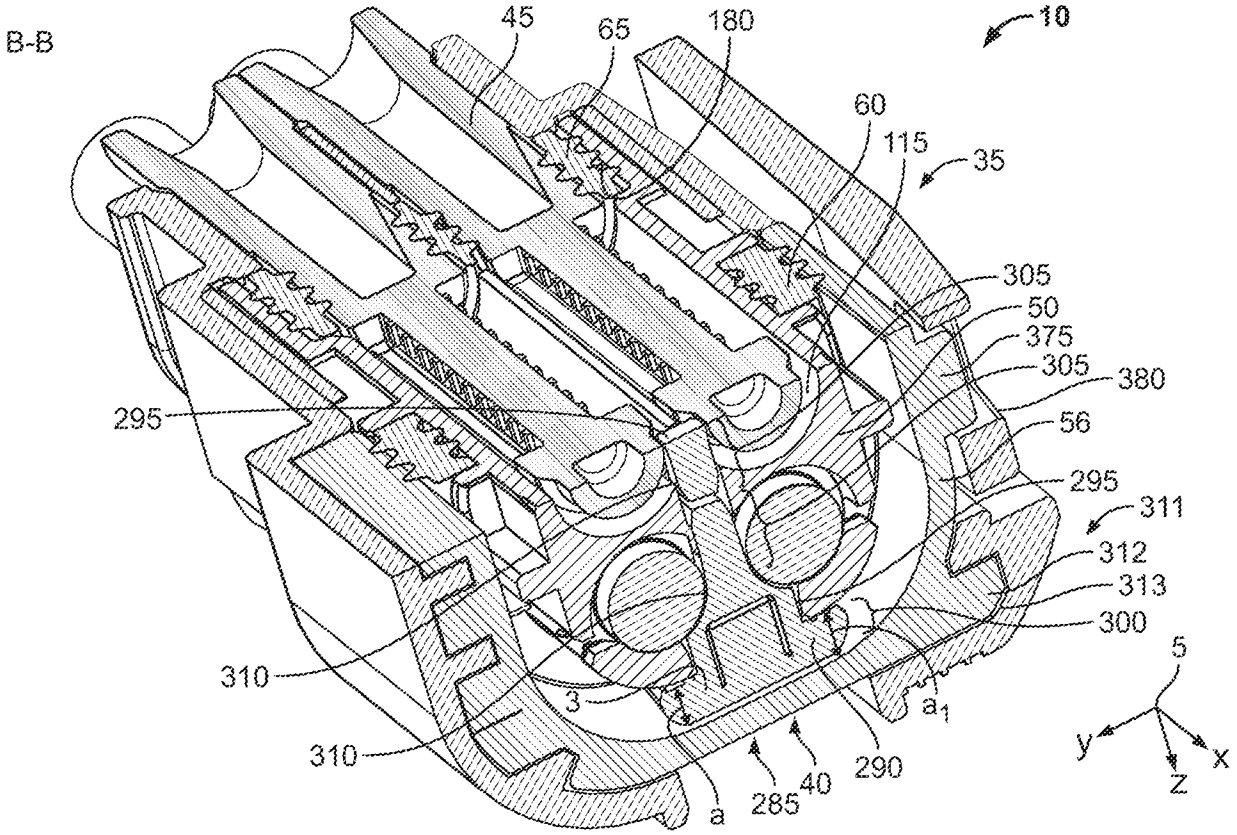
FIG. 6 is a sectional perspective view of the first portion of the contact system, taken along plane B-B of FIG. 4.

The first contact securing device 285 comprises a first pin 290 and a first recess 295, as shown in FIG. 6. Furthermore, a peripherally circumferential, groove-shaped second recess 310 is arranged on the outside of the securing section 120 of the first contact element 45. The first recess 295 is arranged in the inner housing 50. In the embodiment, a first contact securing device 285 is provided respectively for each xy-plane with first contact elements 45. Through the two respective xy-planes, which are arranged offset in the z-direction with the first contact elements 45, the first contact device 35 respectively has two first contact securing device 285, which are arranged opposite each other in the z-direction.

The first pin 290, as shown in FIG. 6, has a first holding section 300 and a first engaging section 305. The first holding section 300 is formed wider than the first recess 295 and the first engaging section 305 in the transverse direction. The first engaging section 305 is formed corresponding at least in sections to the first recess 295 and the second recess 310. The second engaging section 330 is formed in this case such that the first engaging section 305 tapers from the first holding section 300 to a free end of the first engaging section 305. A section of an outer contour of the first engaging section 305 is, in this case, formed running on a circular path. The first engaging section 305 engages through both the first recess 295 and the second recess 310, and thus secures the first contact element 45 in the inner housing 50.

In an embodiment, the first pin 290 has a T-shaped configuration, so that the first engaging section 305 can engage in two contact elements 45, 345 arranged adjacently side-by-side in two different second inner space sections 115 and is simultaneously attached securely against tilting in the first recess 295. In an embodiment, the first holding section 300 is formed wider than the first recess 295 in the transverse direction, in order to prevent the first pin 290 from sliding into the first recess 295.

As shown in FIG. 6, a coding device 311 can be provided, the coding device 311 having a coding rail 312 extending in the longitudinal direction and a coding receptacle 313, the coding rail 312 being arranged by way of example on the outside of the outer housing 56 of the second contact device 40. The coding receptacle 313 is arranged by way of example on the inside of the outer housing 55 of the first contact device 35. The coding rail 312 is formed to engage in the coding receptacle 313 and to guide the outer housing 56 of the second contact device 40. The coding rail 312 and the coding receptacle 313 are arranged such that the second contact device 40 can only be incorporated into the first contact device 35 in a single position. This is guaranteed, for example, by a geometry of the coding rail 312 and the coding receptacle 313 or by an off-centre arrangement of the coding device 311 at the outer housing 55, 56.

The second contact device 40, shown in FIG. 7, is substantially formed as a variant of the first contact device 35 described in FIGS. 1-6. A second contact securing device 315 is provided instead of the first contact securing device 285 at the second contact device 40. Likewise, two second contact securing devices 315, which are arranged opposite each other in the z-direction, are each provided by way of example for securing the second contact elements 345. The second contact securing device 315 is arranged between the inner housing 50 of the first contact device 35 and the inner housing 51 of the second contact device 40 in the longitudinal direction.

In order to avoid an unintentional release of the second contact device 40 from the first contact device 35, the contact system 10 additionally has a latching device 365, shown in FIG. 7. The latching device 365 has a latching clamp 370, which is provided at the outer housing 55 of the first contact device 35, and a latching lug 375, which is provided at the outer housing 56 of the second contact device 40, the latching lug 375 engaging in a latching receptacle 380 of the latching clamp 370 in the assembled state, in order to prevent an unintentional release of the second contact device 40 from the first contact device 35.

As shown in FIG. 8, the second contact securing device 315 is formed similarly to the first contact securing device 285 and has a second pin 327 with a second holding section 326, a second engaging section 330 and a third recess 335, as well as a fourth recess 320. The fourth recess 320 is jointly delimited by the inner housing 50 of the first contact device 35 and the inner housing 51 of the second contact device 40. The second engaging section 330 is connected to the second holding section 326. The second holding section 326 is arranged on the outside of the second engaging section 330. The second engaging section 330 is arranged abutting against the third recess 335 in the longitudinal direction.

As shown in FIG. 7, at the securing section 120, the second contact element 345 has a collar 340 which delimits the second recess 310 at the second contact element 345. The collar 340 is arranged at a free end of the securing section 120 of the second contact element 345 and is formed circumferentially in the peripheral direction of the second contact element 345. The collar 340 of the securing section 120 engages in the third recess 335 of the second pin 327. The second engaging section 330 engages in the second recess 310 of the second contact element 345 and in the fourth recess 320.

The second contact securing device 315 is connected to the inner housing 51 of the second contact device 40 by a latching connection 385, as shown in FIG. 8. The latching connection 385 has a spring section 390 which is attached to the inside of the inner housing 51 of the second contact device 40 at a fixed end. The spring section 390 extends in a yz-plane. Two spring sections 390, which are arranged opposite each other, are provided in a common yz-plane, wherein the second pin 327 is arranged between the spring sections 390.

The spring section 390 has a plurality of fifth recesses 395 on a side which faces the second pin 327. The second contact securing device 315 has a further latching lug 405 at a fourth side surface 400 of the second holding section 326. The further latching lug 405 is formed corresponding to the fifth recess 395. For assembly, the second contact securing device 315 is pressed in between the spring sections 390 in the transverse direction laterally from the outside, such that the second engaging section 330 engages in the second recess 310 and the fourth recess 320. Furthermore, the first engaging section 305 engages in the third recess 335. Moreover, the further latching lug 405 latches in the fifth recess 395 and secures the second pin 327 in the fourth recess 320.

With the second contact securing device 315, a predefined distance between the first inner housing 50 of the first contact device 35 and the inner housing 51 of the second contact device 40 can also be fixed and a position of the second contact element 345 in the inner housing 51 of the second contact device 40 can simultaneously be fixed.

The contact system 10 is particularly compact and reliably seals the first inner space 80 and the second inner space 105 from the environment 245 of the contact system 10. In this way, the reliable prevention of corrosion of the contact element 45, 345 in the region of the electrical contact is guaranteed. Furthermore, as a result of this, the reliability and long durability of the contact system 10 are guaranteed.

With the offset arrangement of the sealing elements 60, 65 in connection with the guide device 250, upon insertion of the second contact device 40 into the first contact device 35, the tilting of the outer housing 56 of the second contact device 40 in relation to the first contact device 35 is avoided. Therefore, damage to the sealing element 60, 65 or crushing of the sealing element 60, 65 by the outer housing 56 of the second contact device 40 is, where applicable, reliably avoided and thus any possible leakage from the inner space 80, 105. A reliable multiple inserting and releasing and a reliable impermeability of the contact system 10 are also guaranteed by the offset arrangement of the sealing element 60, 65.

The first contact device 35 and the second contact device 40 can be easily assembled. The first contact device 35 is assembled by the outer housing 55 being slid over the first electrical conductor 15 in a first method step.

In a second assembly step, the sealing elements 60, 65 are inserted into the respectively associated sealing receptacles 140, 175 of the inner housing 50 of the first contact device 35.

Subsequently, in a third assembly step, the first contact element 45 is inserted into the respectively associated second inner space section 115.

In a fourth assembly step, the first contact securing device 285 is assembled in that the first pin 290 is introduced into the first recess 295, until the first holding section 300 rests on the outside of the inner housing 50 of the first contact device 35 and the first engaging section 305 engages in the second recess 310 of the first contact element 45. As a result, the position in the longitudinal direction of the first contact element 45 relative to the inner housing 50 of the first contact device 35 is reliably fixed. In an embodiment, upon insertion of the first pin 290 into the first recess 295, the first pin 290 is clamped in the first recess 295.

In a fifth assembly step, the outer housing 55 of the first contact device 35 is slid over the inner housing 50 of the first contact device 35, until the first housing section 145 of the inner housing 50 of the first contact device 35 engages in the receptacle 220 of the outer housing 55 of the first contact device 35 and the bearing surfaces 265, 270 are tensioned by the tensioning device 275.

An unwanted release of the first pin 290 from the first recess 295 can be reliably avoided by the outer housing 55 of the first contact device 35 being superimposed on the inner housing 50 of the first contact device 35. In this case, a width a in the vertical direction of the first holding section 300 corresponds substantially to a distance al between the inner housing 50 and the outer housing 56 of the second contact device 40.

The assembly of the second contact device 40 is carried out substantially identically to the assembly of the first contact device 35. In the fourth assembly step, it is not the first contact securing device 285, but the second contact securing device 315 as described in FIG. 8 which is assembled and latched.

During the overall assembly of the contact system 10, the housing engaging section 76 of the outer housing 56 of the second contact device 40 is inserted between the inner housing 50 of the first contact device 35 and the outer housing 55 of the first contact device 35, such that the first sealing element 60 rests on the inside of the housing engaging section 76 and seals off the first inner space 80. Furthermore, the contact elements 45, 345 engage each other and form an electrical contact.

A contact system 10 according to another embodiment is shown in FIGS. 9-12B. The contact system 10 has the first contact device 35 connected to the first electrical conductor 15 and the second contact device 40 connected to the second electrical conductor 20. The first contact device 35 is matable with the second contact device 40 to electrically connect the first electrical conductor 15 and the second electrical conductor 20. Like reference numbers refer to like elements and primarily the differences from the embodiments shown in FIGS. 1-8 will be described in detail herein.

Figure 9:
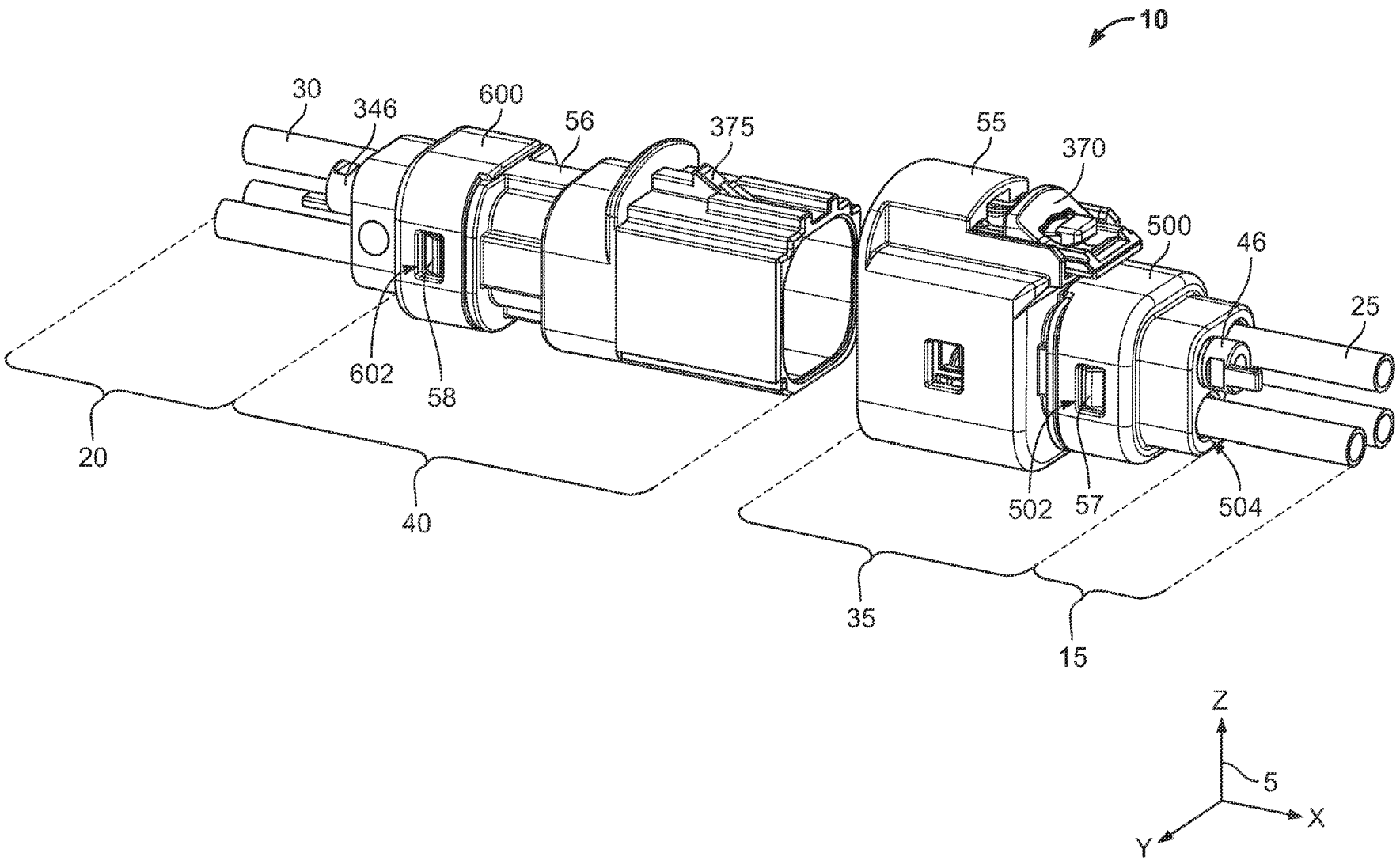
FIG. 9 is an exploded perspective view of a contact system according to another embodiment.
Figure 10:
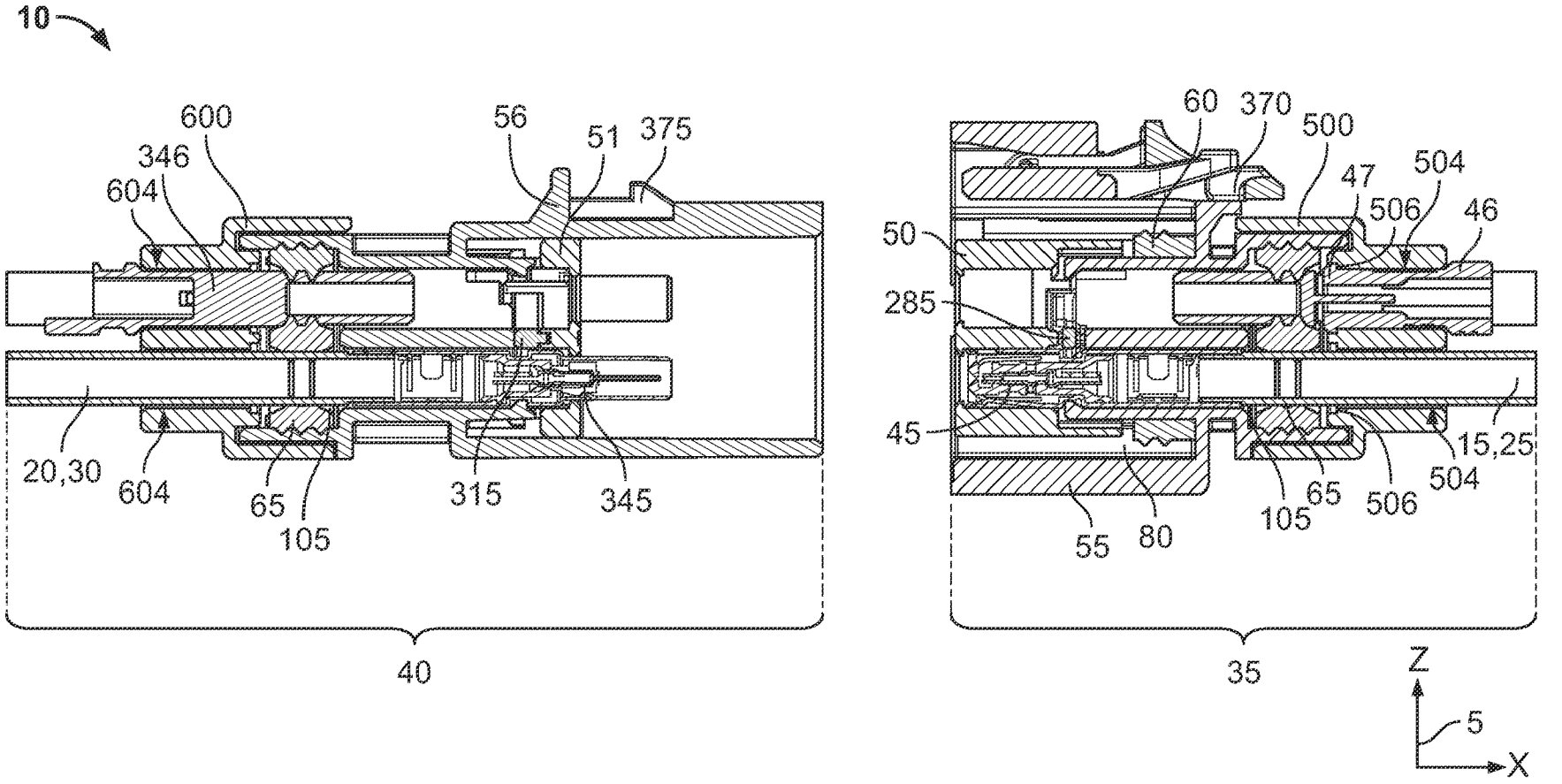
FIG. 10 is a sectional side view of the contact system of FIG. 9.
Figure 11:
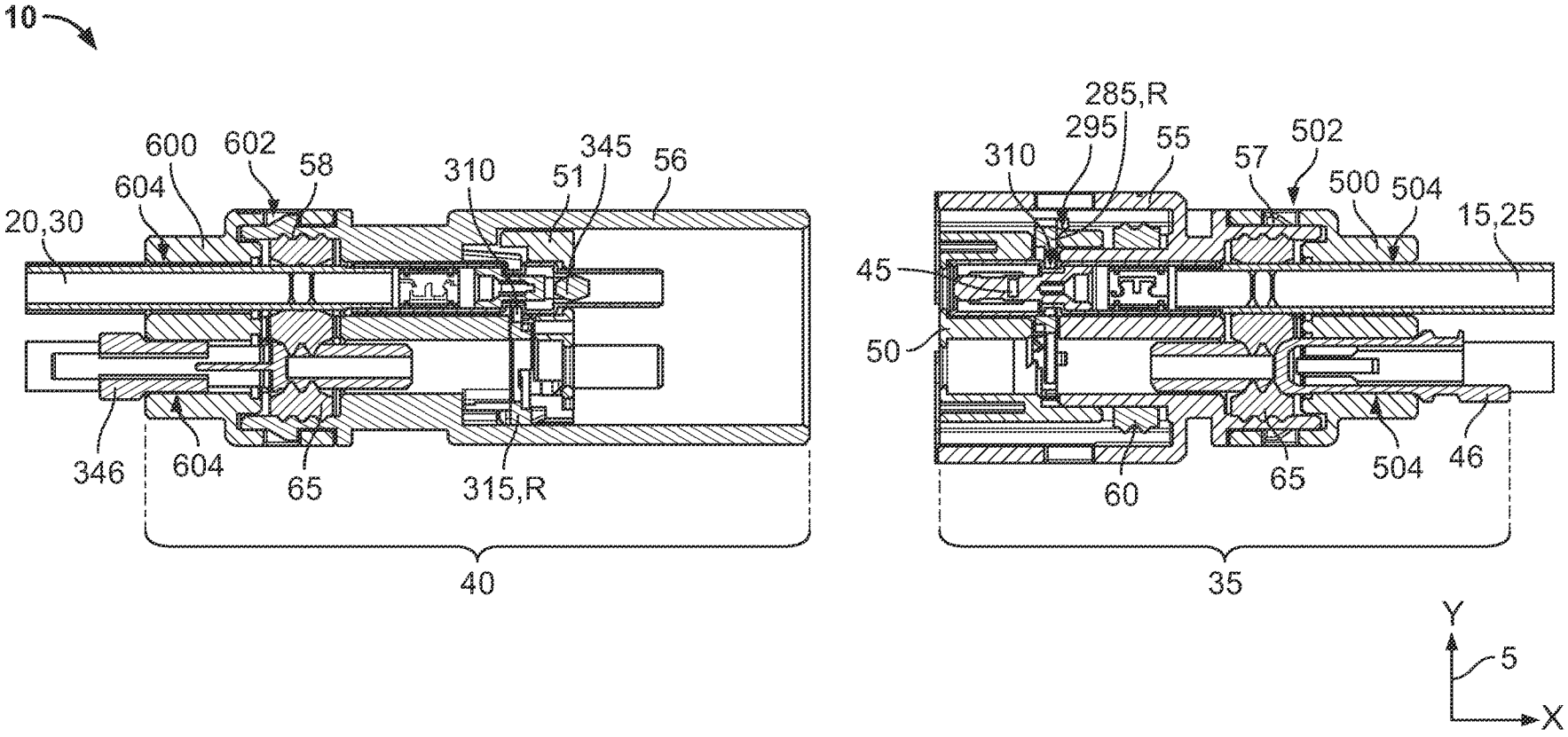
FIG. 11 is a sectional top view of the contact system of FIG. 9.

The first contact device 35, in the embodiment shown in FIGS. 9-11, has the first contact element 45 held within the inner housing 50 and the outer housing 55. The first contact device 35 has the first sealing element 60 disposed around a portion of the outer housing 55 and abutting the outer housing 56 of the second contact device 40 to seal the first inner space 80 in a mated state of the contact system 10. The first contact device 35 has the second sealing element 65 disposed between an inner surface of the outer housing 55 and the first electrical conductor 15 to seal the second inner space 105.

As shown in the embodiment of FIGS. 9-11, the first contact device 35 has a first cover 500 disposed over an end of the outer housing 55 in the longitudinal direction. In the shown embodiment, the outer housing 55 has a cantilevered latch 57 at a rear end of the outer housing 55 in the longitudinal direction. The first cover 500 has an opening 502 and, when the first cover 500 is inserted over the end of the outer housing 55 in the longitudinal direction, the cantilevered latch 57 is deflected until the first cover 500 reaches the position shown in FIGS. 9 and 11, in which the cantilevered latch 57 elastically returns and engages in the opening 502. The engagement of the cantilevered latch 57 with the opening 502 holds the first cover 500 in position on the outer housing 55. In other embodiments, the first cover 500 could be attached to the outer housing 55 and secured in the position shown in FIGS. 9 and 11 by other releasable attachment devices. The second sealing element 65 is positioned in the longitudinal direction between the outer housing 55 and the first cover 500.

As shown in FIGS. 9-11, either one of the conductor strands 25 or the sealing plug 46 is positioned in each of a plurality of passageways 504 of the first cover 500, which are aligned with passageways in the outer housing 55 and inner housing 50 into which the first contact elements 45 or the sealing plug 46 extend.

As shown in FIG. 10, the first cover 500 has a seat 506 at an end of each of the passageways 504 facing the outer housing 55. The seat 506 has a larger diameter than the passageway 504 in a plane extending in the vertical direction and the transverse direction, forming a surface of the seat 506 extending in the vertical direction and facing toward the outer housing 55.

As shown in FIG. 10, the sealing plug 46 has a latch portion 47 extending circumferentially around the sealing plug 46 that is elastically deflectable. When the sealing plug 46 is inserted into the passageway 504 of the first cover 500 along the longitudinal direction, the latch portion 47 elastically deflects within the passageway 504. When the sealing plug 46 reaches the position shown in FIG. 10, the latch portion 47 elastically returns and engages the seat 506, securing the sealing plug 46 to the first cover 500 along the longitudinal direction. In the shown embodiment, the sealing plug 46 is monolithically formed in a single piece with the latch portion 47.

The first contact device 35, as shown in FIGS. 10-12B, has a first contact securing device 285 to secure the first contact elements 45 in position in the inner housing 50 and the outer housing 55. Instead of the two pieces of the embodiment shown in FIGS. 2 and 6, the first contact device 35 has a single first contact securing device 285 in the embodiment shown in FIGS. 10-12B that is capable of simultaneously securing all of the first contact elements 45 in the first contact device 35.

Figure 12B:
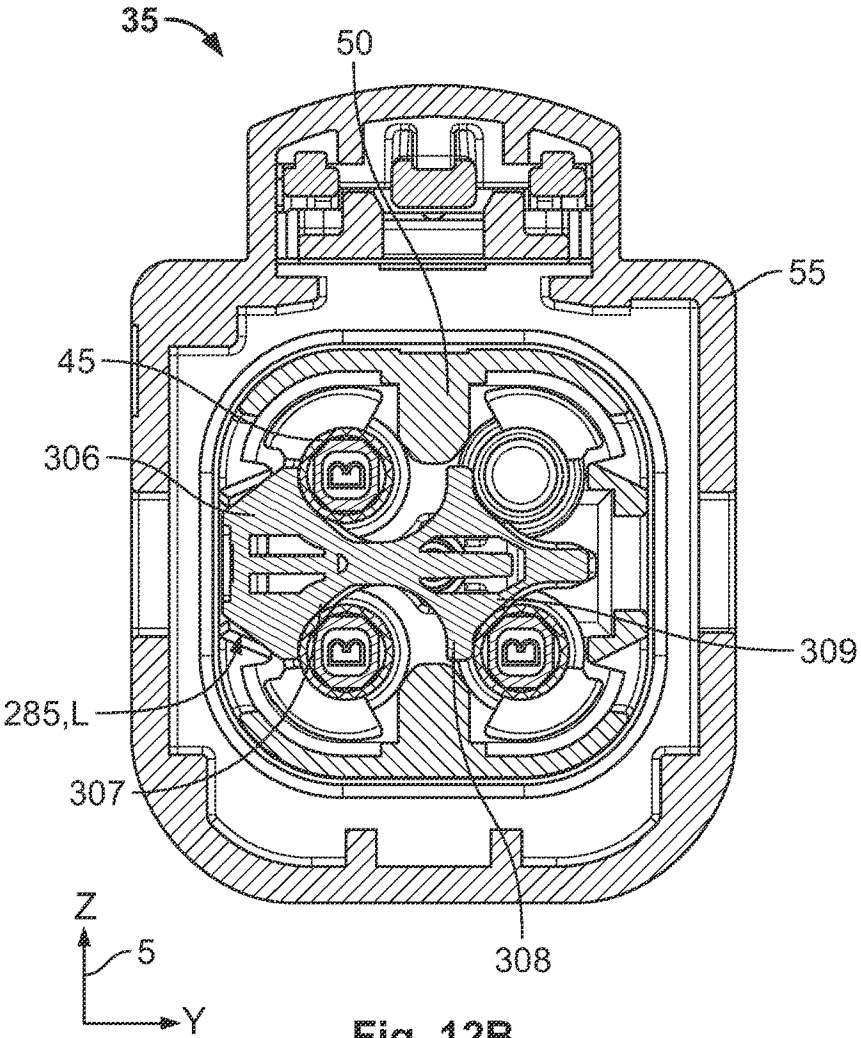
FIG. 12B is a sectional end view of the first contact device with the first contact securing device in a secondary locked position.
Figure 12A:
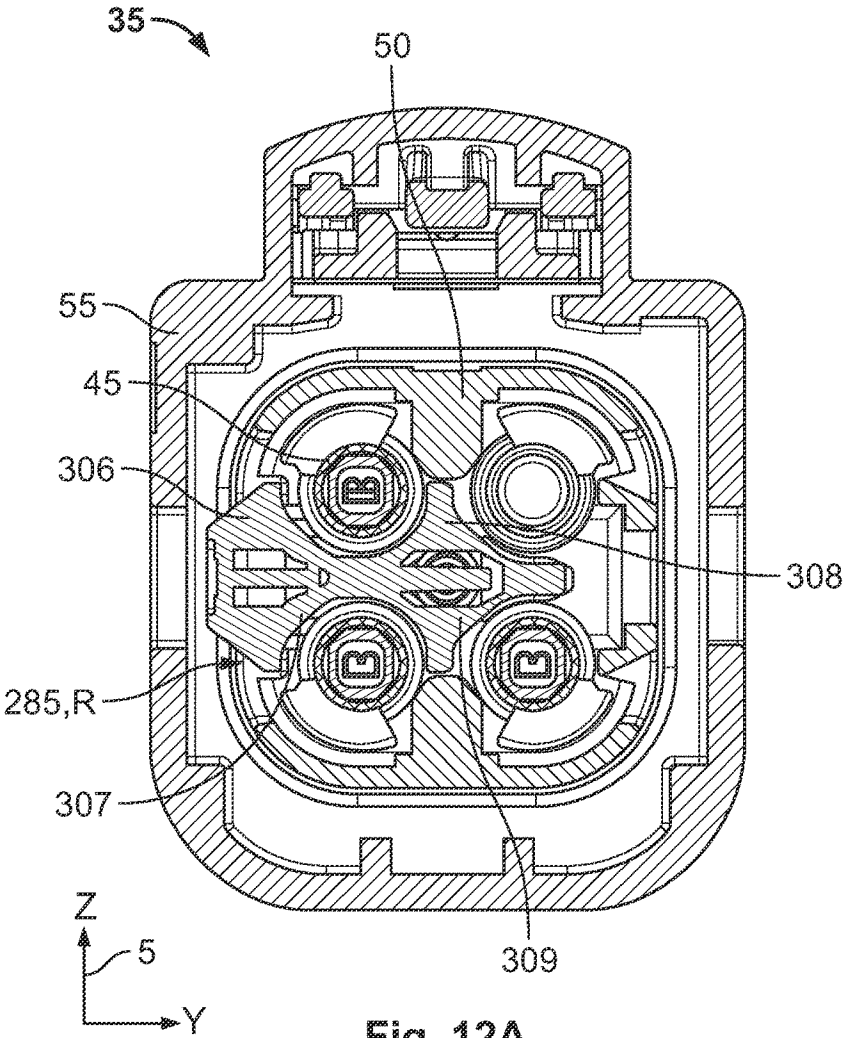
FIG. 12A is a sectional end view of a first contact device of the contact system with a first contact securing device in a released position.

As shown in the embodiment of FIGS. 12A and 12B, the first contact securing device 285 has a first holding section 306, a first engaging section 307 extending from the first holding section 306, a second holding section 308 extending from the first engaging section 307, and a second engaging section 309 extending from the second holding section 308. The first contact securing device 285 is monolithically formed in a single piece with the sections 306, 307, 308, 309. The first holding section 306 and the second holding section 308 are wider than the first engaging section 307 and the second engaging section 309. The first engaging section 307 has a semicircular profile between the first holding section 306 and the second holding section 308, and the second engaging section 309 tapers from the second holding section 308 to a free end of the second engaging section 309.

The first contact securing device 285 is shown in a released position R in FIGS. 11 and 12A. In the released position R, the first contact securing device 285 is in the first recess 295 of the inner housing 50 and is spaced apart from each of the first contact elements 45. Each of the first contact elements 45 is positioned in a space defined by the first engaging section 307 or the second engaging section 309 in the released position R.

The first contact securing device 285 is moved along the transverse direction in the first recess 295 to a secondary locked position L shown in FIG. 12B. In the secondary locked position L, the first engaging section 307 engages the second recess 310 of two of the first contact elements 45 and the second engaging section 309 engages the second recess 310 of the other two first contact elements 45. The single first contact securing device 285 moves from the released position R to the secondary locking position L to secure all of the first contact elements 45 with respect to the inner housing 50 and the outer housing 55 along the longitudinal direction. The engagement of the engaging sections 307, 309 with the second recesses 310 occurs similarly to the embodiment described with respect to FIGS. 2 and 6 above but, in the shown embodiment, occurs by moving a single first contact securing device 285 in a single direction instead of moving two first contact securing devices 285 in opposite directions.

The second contact device 40, in the embodiment shown in FIGS. 9-11, is formed similarly to the first contact device 35 and has the second contact element 345 held within the inner housing 51 and the outer housing 56. The second contact device 40 has the second sealing element 65 disposed between an inner surface of the outer housing 56 and the second electrical conductor 20 to seal the second inner space 105.

In the embodiment shown in FIGS. 9-11, the second contact device 40 does not have the first sealing element 60 of the embodiment shown in FIG. 3. The outer housing 56 and the inner housing 51 in the embodiment of FIGS. 9-11 are arranged such that a sealing of the second contact device 40 and the contact system 10 can occur without the first sealing element 60 of the embodiments described above.

As shown in the embodiments of FIGS. 9-11, the second contact device 40 has a second cover 600 disposed over an end of the outer housing 56 in the longitudinal direction. In an embodiment, the second cover 600 is identical to the first cover 500. In the shown embodiment, the outer housing 56 has a cantilevered latch 58 at a rear end of the outer housing 56 in the longitudinal direction. The second cover 600 has an opening 602 and, when the second cover 600 is inserted over the end of the outer housing 56 in the longitudinal direction, the cantilevered latch 58 is deflected until the second cover 600 reaches the position shown in FIGS. 9 and 11, in which the cantilevered latch 58 elastically returns and engages in the opening 602. The engagement of the cantilevered latch 58 with the opening 602 holds the second cover 600 in position on the outer housing 56. In other embodiments, the second cover 600 could be attached to the outer housing 56 and secured in the position shown in FIGS. 9 and 11 by other releasable attachment devices. The second sealing element 65 is positioned in the longitudinal direction between the outer housing 56 and the second cover 600.

As shown in FIGS. 9-11, either one of the conductor strands 30 or the sealing plug 346 is positioned in each of a plurality of passageways 604 of the second cover 600, which are aligned with passageways in the outer housing 56 and inner housing 51 into which the second contact elements 345 or the sealing plug 346 extend.

The second contact device 40, as shown in FIGS. 10 and 11, has a second contact securing device 315 to secure the second contact elements 345 in position in the inner housing 51 and the outer housing 56. The second contact securing device 315 is formed identically and functions identically to the first contact securing device 285 shown and described with respect to FIGS. 11, 12A, and 12B, but moves to engage the second recess 310 of the second contact elements 345.

In the contact system 10 according to the embodiment shown in FIGS. 9-11, the first contact device 35 is mated with the second contact device 40 by moving the second contact device 40 into the first contact device 35 along the longitudinal direction. The outer housing 56 of the second contact device 40 is inserted between the inner housing 50 and the outer housing 55 of the first contact device 35, such that the first sealing element 60 in the first contact device 35 engages the outer housing 56 and seals the first inner space 80. Furthermore, the contact elements 45, 345 engage each other and form an electrical contact. The latching lug 375 engages the latching clamp 370 in the assembled state as described in the embodiments above to prevent the unintentional release of the second contact device 40 from the first contact device 35.

What is claimed is:

1. A contact device, comprising:

an outer housing delimiting an inner space;

an inner housing arranged in the inner space, the inner housing having a first recess;

a contact element arranged in the inner space, the contact element has a second recess on an outside of the contact element aligned with the first recess wherein the contact element is of a plurality of contact elements arranged in the inner space, each of the contact elements have a second recess;

a sealing element arranged between the contact element and the outer housing, the sealing element sealing the inner space from the environment; and a contact securing device movable along the first recess to engage the second recess of the contact element, the contact securing device is formed in a single piece and is capable of simultaneously engaging the second recess of all of the contact elements wherein the contact securing device has:

a first holding section and a first engaging section extending from the first holding section, the first holding section is wider than the first engaging section; and a second holding section extending from the first engaging section, the second holding section is wider than the first engaging section.

2. The contact device of claim 1, further comprising a cover disposed over an end of the outer housing in the longitudinal direction and attached to the outer housing.

3. The contact device of claim 2, wherein the cover has a plurality of passageways aligned with passageways in the outer housing and the inner housing.

4. The contact device of claim 3, further comprising a sealing plug having an identical outer contour to the contact element in sections, one of the sealing plug and the contact element is arranged in each of the passageways of the cover.

5. The contact device of claim 4, wherein the sealing plug has a latch portion that is elastically deflectable, the latch portion engaging a seat at an end of the passageway of the cover to secure the sealing plug in the passageway.

6. The contact device of claim 2, wherein the sealing element is arranged between the outer housing and the cover along the longitudinal direction.

7. The contact device of claim 1, wherein the contact device does not have a sealing element between the inner housing and the outer housing.

8. The contact device of claim 1, further comprising a tensioning device arranged on an outside of the inner housing and formed to press a first bearing surface of the outer housing against a second bearing surface of the inner housing.

9. A contact device, comprising:

an outer housing delimiting an inner space;

a contact element arranged in the inner space, the contact element has a second recess on an outside of the contact element aligned with the first recess;

a sealing element arranged between the contact element and the outer housing, the sealing element sealing the inner space from the environment; and a contact securing device movable along the first recess to engage the second recess of the contact element, the contact securing device is formed in a single piece and is capable of simultaneously engaging the second recess of all of the contact elements wherein the contact device has:

a first holding section and a first engaging section extending from the first holding section, the first holding section is wider than the first engaging section and a second holding section extending from the first engaging section, the second holding section is wider than the first engaging section wherein the first engaging section has a semicircular profile between the first holding section and the second holding section.

10. The contact device of claim 9, wherein the contact securing device has a second engaging section extending from the second holding section.

11. The contact device of claim 10, wherein the second engaging section tapers from the second holding section to a free end of the second engaging section.

12. The contact device of claim 10, wherein the contact securing device is movable between a released position and a secondary locked position in the first recess, the contact securing device secures the contact element against movement along a longitudinal direction in the secondary locked position.

13. The contact device of claim 12, wherein the first engaging section engages the second recesses of a first group of the plurality of contact elements and the second engaging section engages the second recesses of a second group of the plurality of contact elements in the secondary locked position.

14. A contact system, comprising:

a first contact device including a first outer housing delimiting a first inner space, a first inner housing arranged in the first inner space, a first contact element arranged in the first inner space, a first sealing element arranged around a portion of the first outer housing, and a second sealing element arranged between the first contact element and the first outer housing, the second sealing element sealing the first inner space from the environment; and a second contact device including a second outer housing delimiting a second inner space, a second inner housing arranged in the second inner space, a second contact element arranged in the second inner space, and a third sealing element arranged between the second contact element and the second outer housing, the third sealing element sealing the second inner space from the environment, the second outer housing engages the first sealing element to form a seal between the first contact device and the second contact device wherein each of the first contact device and the second contact device has a contact securing device movable along the first inner housing or the second inner housing to engage the first contact element or the second contact element.

15. The contact system of claim 14, wherein the second contact device does not have a sealing element between the second inner housing and the second outer housing.

* * * * *